US009651215B1

(12) United States Patent
Britten et al.

(10) Patent No.: US 9,651,215 B1
(45) Date of Patent: May 16, 2017

(54) LIGHTBOX WITH STORAGE FOR INTERCHANGEABLE GRAPHIC PANELS AND RELATED ASSEMBLIES, COMPONENTS, AND METHODS

(71) Applicants: Ronald E. Britten, Timberlea (CA); John D. Coffin, New Glasgow (CA)

(72) Inventors: Ronald E. Britten, Timberlea (CA); John D. Coffin, New Glasgow (CA)

( * ) Notice: Subject to any disclaimer, the term of this patent is extended or adjusted under 35 U.S.C. 154(b) by 40 days.

(21) Appl. No.: 14/706,955

(22) Filed: May 7, 2015

Related U.S. Application Data

(60) Provisional application No. 61/990,091, filed on May 7, 2014.

(51) Int. Cl.

| | |
|---|---|
| ***F21V 3/04*** | (2006.01) |
| ***F21V 23/06*** | (2006.01) |
| ***F21V 15/01*** | (2006.01) |
| ***F21S 6/00*** | (2006.01) |
| *F21Y 101/02* | (2006.01) |
| *F21W 121/00* | (2006.01) |

(52) U.S. Cl.
CPC ..... *F21V 3/049* (2013.01); *F21S 6/00* (2013.01); *F21V 15/01* (2013.01); *F21V 23/06* (2013.01); *F21W 2121/004* (2013.01); *F21Y 2101/02* (2013.01)

(58) Field of Classification Search
CPC ..... F21V 3/049; F21V 15/01; F21V 23/06; F21V 13/00; F21V 13/02; F21V 13/04; F21V 13/10; F21V 15/02; F21V 21/00; F21V 14/00; F21S 6/00; F21W 2121/004; F21Y 2101/02; G09F 13/04; G09F 13/00; G09F 13/0404; G09F 13/0413; G09F 2013/0445; G09F 13/18; G09F 2013/1872; G09F 2013/1877; G09F 2013/1881
See application file for complete search history.

(56) References Cited

U.S. PATENT DOCUMENTS

| | | | | |
|---|---|---|---|---|
| 5,943,801 | A * | 8/1999 | Wilkinson | G09F 13/04 40/564 |
| 6,821,002 | B1 * | 11/2004 | Morgen | F21S 6/005 362/351 |
| 6,920,711 | B2 * | 7/2005 | Miller | G09F 1/12 40/715 |
| 7,044,626 | B2 * | 5/2006 | Randak | G09F 13/04 362/353 |

* cited by examiner

*Primary Examiner* — Bao Q Truong
(74) *Attorney, Agent, or Firm* — Fantastic IP Consulting; Eduardo E. Drake

(57) ABSTRACT

To address one or more problems with conventional lightbox displays, particularly those suitable for use during holidays and other special occasions, the present inventor devised, among other things, lightboxes with integrated storage for graphic image sheets that are not in use. Some embodiments include removable base structures with storage for power cords and adapters.

17 Claims, 6 Drawing Sheets

LIGHTBOX WITH STORAGE FOR INTERCHANGEABLE GRAPHIC PANELS AND RELATED ASSEMBLIES, COMPONENTS, AND METHODS

RELATED APPLICATION

The present application claims priority to U.S. Provisional Patent Application 61/990,091, which was filed May 7, 2014 and which is incorporated herein by reference.

COPYRIGHT NOTICE AND PERMISSION

A portion of this patent document contains material subject to copyright protection. The copyright owner has no objection to the facsimile reproduction by anyone of the patent document or the patent disclosure, as it appears in the patent and trademark office patent files or records, but otherwise reserves all copyrights whatsoever. The following notice applies to this document: Copyright © 2014, RONALD E. BRITTEN AND JOHN COFFIN.

TECHNICAL FIELD

Various embodiments of the invention relate generally to illuminated signage devices, particularly backlit graphic display devices.

BACKGROUND

Millions of people around the world enjoy celebrating holidays, such as Halloween, Thanksgiving, Christmas, Hanukah, Rosh Hashanah, Kwanzaa, New Years, and so forth. Celebration often entails people displaying illuminated devices in their windows for home residents, guests, and passersby to enjoy.

One conventional form of illuminated device takes the form of a device that backlights a translucent and/or transparent sheet of glass or plastic having a themed graphical design, such as a Jack-o-lantern, turkey, Christmas tree, etc. These are sometimes called backlit graphical displays or lightboxes. Some lightboxes allow replacing the glass or plastic sheet for one holiday with a glass or plastic sheet for another, thus allowing use of the device for a wide range of holidays, special occasions, or other home signage.

The present inventor recognized that conventional lightboxes are problematic for several reasons. First, the interchangeable graphic sheets are at risk of being lost or damaged, because conventional lightboxes lack a way of storing the sheets that are not in use during a particular holiday. Second, many lightboxes are designed to stand upright on window sills with a solid base, but some window sills are too small for some light boxes, limiting their use. Third, many lightboxes use separate AC adapters for power, which can not only be lost or confused with the adapters for other devices, but can also detract from the beauty of holiday decorations.

Accordingly, the present inventor has recognized a need for better lightboxes.

SUMMARY

To address one or more of these and/or other needs or problems, the present inventor devised, among other things, one or more exemplary systems, kits, methods, devices, assemblies, and/or components related to structure and use of lightboxes.

In one exemplary embodiment, the invention takes the form of lightbox assembly having an integrated storage compartment for storing unused graphic sheets. In particular, this assembly includes a light diffusion panel, a clear front display panel, and a storage area. The light diffusion panel, which includes or interfaces with one or more adjacent light sources, is positioned behind the clear front display panel, creating a space for receiving transparent or translucent graphic image sheet. The storage area is positioned behind the light diffusion panel, providing storage for multiple graphic image sheets.

Some embodiments provide the lightbox with a removable base structure, which maintains it in an upright position on wider windowsills and is removable to allow use of the lightbox on narrower sills. For windows with narrower sills or no sills, some embodiments provide a smaller base structure and/or features, such as snap-on suction cups or adhesive hooks or pegs, for attaching one or more points of the lightbox to a window surface and thus preventing it from tipping over. Additionally, some embodiments provide two AC adapter ports, one on the underside of the light box for use when the base is attached, and one on the side of the light box for use when the base is removed, making it even easier to position the lightbox on a variety of windows.

In some embodiments, the base is also configured to store an AC power adapter and a power cord, not only when the lightbox is not in use, but also for windowsills that include a built-in power outlet, preventing loss of the AC adapter during periods of non-use and eliminating or reducing unsightly cord clutter.

BRIEF DESCRIPTION OF THE DRAWINGS

Various embodiments are described herein with reference to the following attached figures (Figs). These figures are annotated with reference numbers for various features and components, and these numbers are used in the following description as a teaching aid, with like numbers referring to the same or similar features and components.

DETAILED DESCRIPTION OF THE EXEMPLARY EMBODIMENT(S)

This document, which incorporates drawings and claims, describes one or more specific embodiments of one or more inventions. These embodiments, offered not to limit but only to exemplify and teach the invention, are shown and described in sufficient detail to enable those skilled in the art to implement or practice the invention(s). Thus, where appropriate to avoid obscuring the invention(s), the description may omit certain information known to those of skill in the art.

Figure 1:
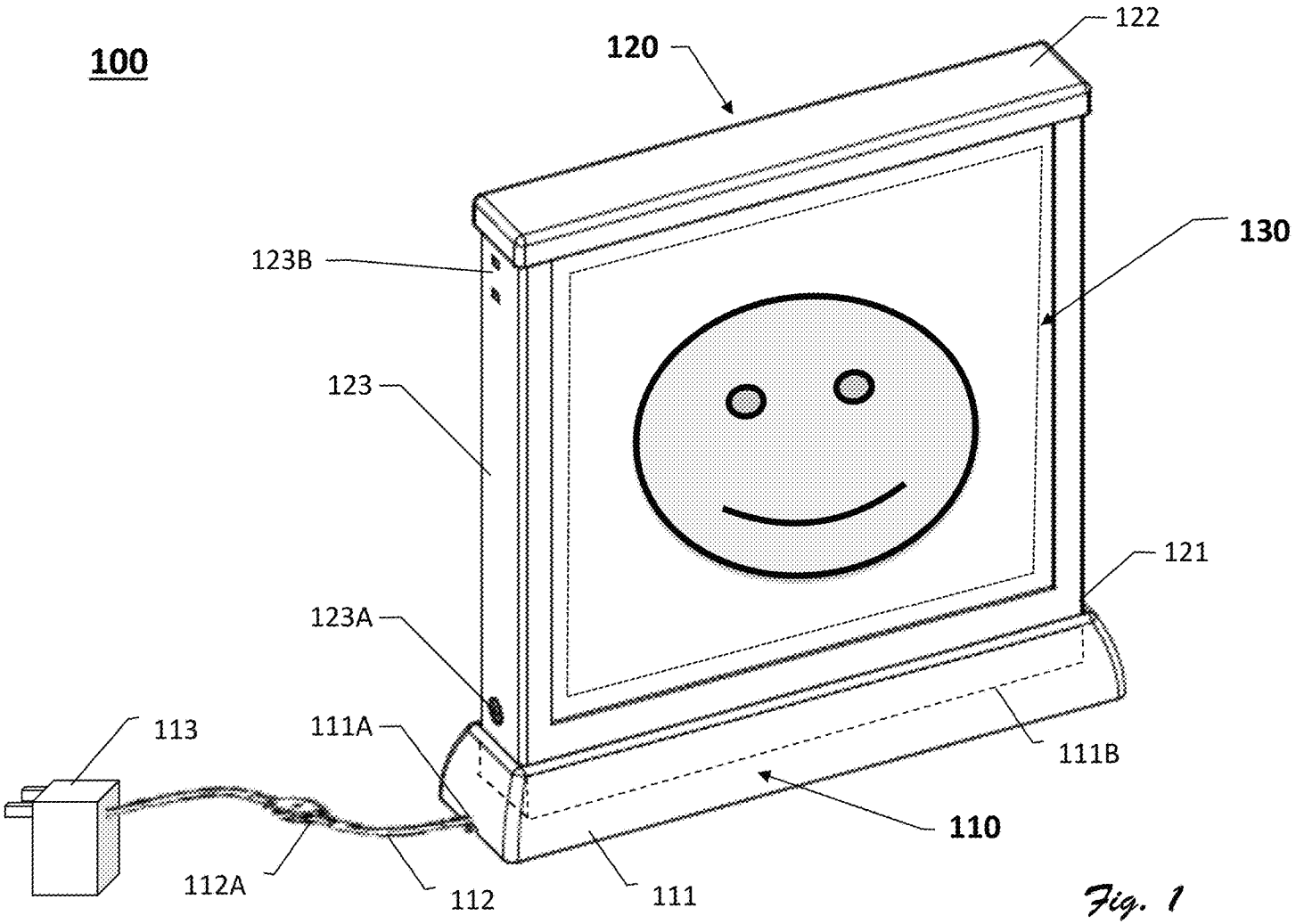
FIG. 1 is a front perspective view of a lightbox corresponding to one or more embodiments of the present invention.

FIG. 1 shows a lightbox system 100, including a base assembly 110, a lightbox assembly 120, and a set of one or more graphic display sheets 130.

Base assembly 110 includes a removable base support 111, a power cord 112, and an AC adapter plug 113. Base support 111, an elongated injection-molded plastic structure in the exemplary embodiment, has an inverted trough-like form, with a cord notch 111A and a rectangular recess 111B. Cord notch 111A allows base support 111 to rest flush on a window sill or other flat surface as power cord 112 passes underneath to an interior region of the base to connect with a female AC adapter jack (not visible) in the bottom of lightbox 120. Power cord 112 includes an inline control element 112A for turning the lightbox system on or off or otherwise controlling one or more other aspects of its operation. In some embodiments, control element 112A takes the form of a scroll switch; however, in other embodiments, it may include a photoelectric switch and/or programmable timer for automatically turning the lightbox on and off in response to ambient light conditions, at specific dates and/or times of day, and or in specific blinking patterns. In some embodiments, one or more portions of control element 112A are positioned at different locations on the base or other component of system 100.

Cord 112 terminates at AC adapter plug 113. AC adapter plug 113 includes conventional transformer and power conditioning circuitry for converting 110/120 VAC outlet power to a DC voltage, for example 5 volts. Rectangular recess 111B removably engages in an interference fit with a lower portion 121 of lightbox assembly 120.

Figure 2:
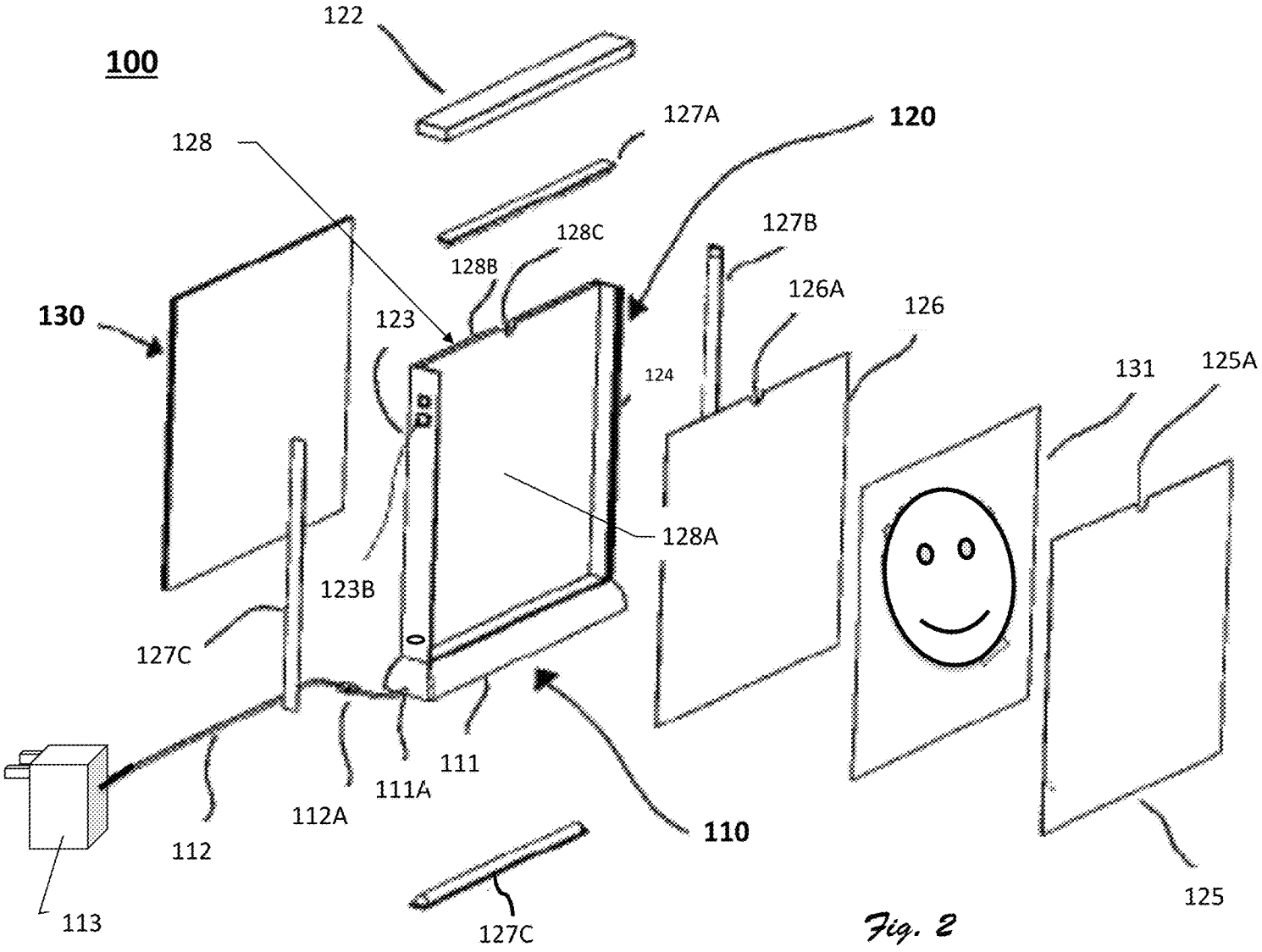
FIG. 2 is an exploded perspective view of the FIG. 1 lightbox, corresponding to one or more embodiments of the present invention.
Figure 3:
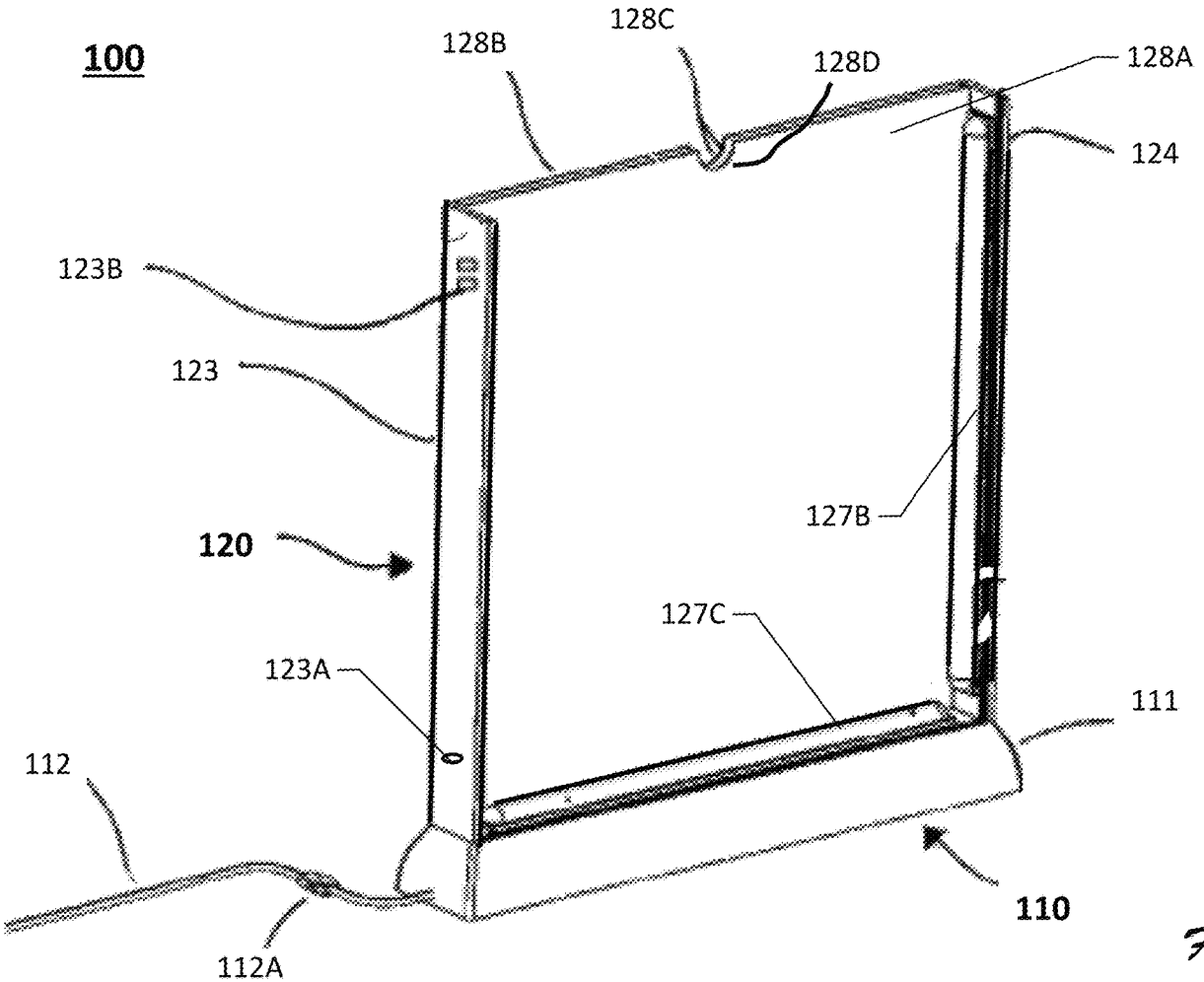
FIG. 3 is a perspective front view of a subassembly of the FIG. 1 lightbox, corresponding to one or more embodiments of the present invention.

Lightbox assembly 120, shown also in the exploded view of FIG. 2 and the subassembly perspective of FIG. 3, also includes a removable top 122, vertical side walls 123 and 124, a transparent front panel 125, a light diffuser panel 126, lighting elements 127A-127D, and a graphic sheet storage compartment 128. Removable top 122 engages in an interference fit with an upper portion of the assembly, covering the space between vertical side panels 123 and 124. Vertical sidewall 123 includes a female AC adapter jack 123A and window attachment point(s) 123B. Vertical sidewall 124 includes window attachment point(s) 1248. In some embodiments, the interior surface of top 122 as well as the sidewalls are covered with reflective coating to promote transmission of light through the assembly.

Transparent front panel 125, held between sidewalls 123 and 124, protects and provides visibility of a removable graphic display sheet 131, positioned between front panel 125 and diffuser panel 126. (In some embodiments, front panel 125 may have lenticular grooves to coordinate with interlaced images on the graphic display sheet and produce blinking, movement, and/or 3D effects.) Front panel 125 and diffuser panel 126 include respective notches 125A and 126A to facilitate manual removal of the graphic display sheet.

Figure 6:
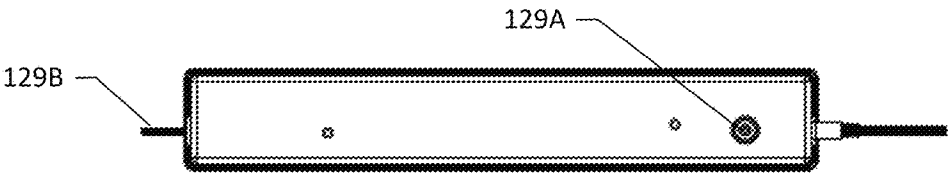
FIG. 6 is a bottom view of the FIG. 1 lightbox without the base structure and corresponding to one or more embodiments of the present invention.

Light diffuser panel 126, formed for example of an optical acrylic plastic sheet approximately 1-4 millimeters thick, has its 4 edges positioned adjacent respective lighting elements 127A, 127B, 127C, and 127D, which are electrically coupled together in parallel to AC adapter jack 123A and AC adapter jack 129 (visible in FIG. 6). In some embodiments, light diffuser panel 126 includes etching or a reflective film (for example vapor-deposited aluminum) on one side to reflect light toward the front of the lightbox. Lighting elements 127A-127D can take a variety forms; however, in the exemplary embodiment, each light element includes one or two rows of white or near-white Light Emitting Diodes (LEDs) positioned at one or more edges of the diffuser to transmit light through the diffuser peripheral edges and out through its front surface. The LEDs are interconnected in series or in parallel on a printed circuit board or flex circuit. Some embodiments replace the light elements and light diffuser panel with an array of LEDs, for example an array of surface-mounted conventionally sized or nano-sized LEDs (2 mm, 1 mm, or smaller.) Some embodiments use fluorescent, compact fluorescent, and/or incandescent lighting. Behind light diffuser panel 126 is graphic sheet storage compartment 128.

Storage compartment 128, shown best in FIG. 3, includes two spaced panels 128A and 128B, with panel 128B serving as a back panel of lightbox 120. Panels 128A and 128B, which are formed of plastic, paper, metal, or other suitable sheet material and spaced 4-15 millimeters in the exemplary embodiment, include respective notches 128C and 128D, to facilitate manual gripping and removal of one or more graphic display sheets 130.

Graphic display sheets 130, in the exemplary embodiment, include a set of one of more sheets, transparent and/or translucent plastic or mylar sheets. The set includes one or more sheets relating to one or more of the following holidays or special occasions: Halloween, Thanksgiving, Christmas, Hanukah, Rosh Hashanah, Kwanzaa, New Year's Day, Valentine's Day, Easter, Mother's Day, Memorial Day, Father's Day, Independence Day, Labor Day, birthdays, new births, and so forth. Additionally, some embodiments provide sheets bearing indicia related to various amateur and professional athletic teams for various sports including football, basketball, baseball, hockey, soccer, and/or auto-racing.

In some embodiments, the background color used may be black so that only the colored graphic will display when the light shines through. In some embodiments, two or more images are interlaced for use with a lenticular formatted front panel, or the sheet itself is a transparent lenticular formatted display, producing blinking, moving images, or 3D effects. Also, in some embodiments, two or more sheets are designed for insertion at the same time, providing compound image effects. In some of these embodiments, the sheets may have cutouts of various shapes. In the exemplary embodiment, the sheets are the approximate size of the front panel to fit within the lightbox. When not in use, the image sheets are stored in the device's rear storage compartment 128. When a particular graphic sheet is chosen for display, one removes it from the storage compartment and places it between front panel 125 and diffuser panel 126, using control element 112A to turn on the lightbox and illuminate the selected sheet(s).

Figure 4:
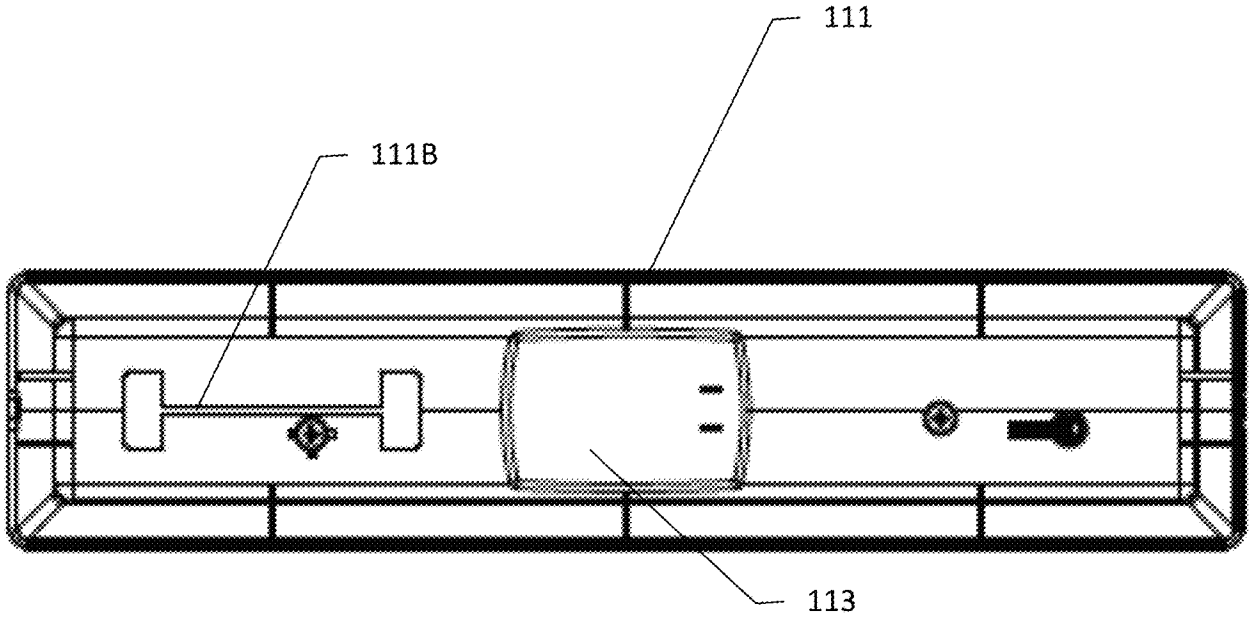
FIG. 4 is a bottom view of the FIG. 1 lightbox, showing details of the base structure and corresponding to one or more embodiments of the present invention.

FIG. 4, a bottom view of lightbox assembly 120, shows that underside of base support 111 includes a power cord spool 111B and a place for storing power adapter 113. This configuration allows a user to plug the device into a horizontally and flush mounted power outlet such as found in some windowsills, completely hiding the a/c adapter and electrical cord from view. Some embodiments include a battery box in place of the power adapter, or a rechargeable battery along with the power adapter.

Figure 5:
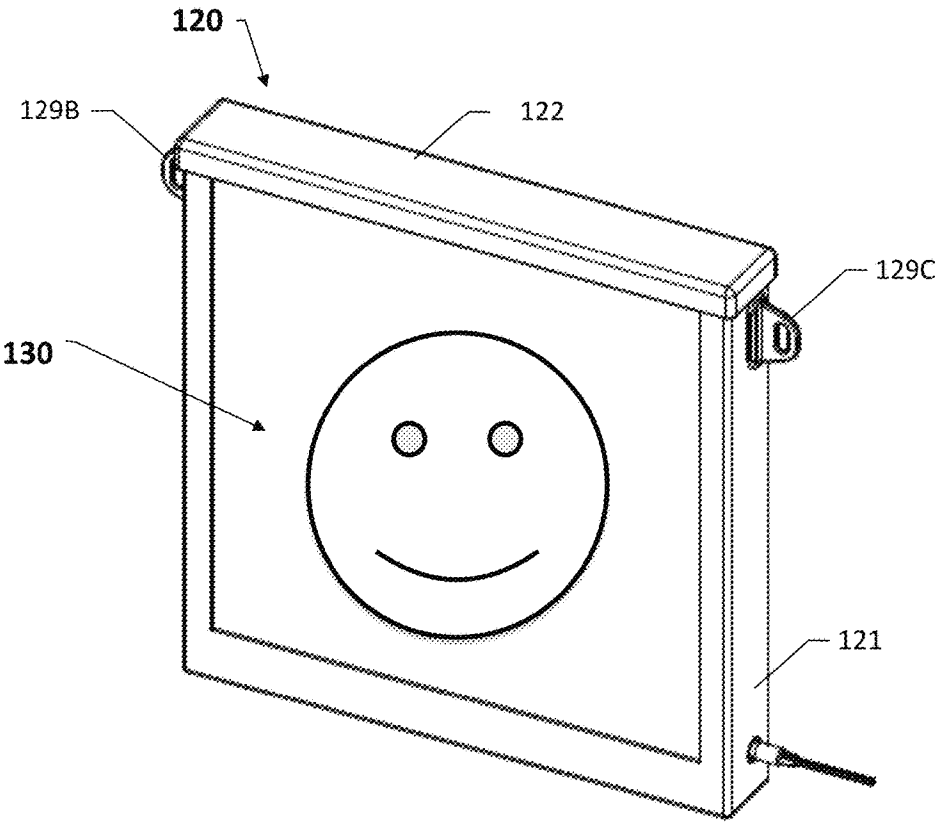
FIG. 5 is a front view of the FIG. 1 lightbox with base structure removed and window attachment features installed, corresponding to one or more embodiments of the present invention.

FIGS. 5 and 6 show respective front and bottom views of light assembly 120 with removal of base support 111 and with insertion or attachment of window attachment features 129A and 129B. This configuration allows for placement of the lightbox assembly on windows with narrower sills or windows that have no sill without risk of the assembly tipping over. In particular, FIG. 5 shows that window attachment features 129B and 129C, for example attachment eyelets or suction cup brackets, inserted into respective attachment points 123B and 124B. Using the attachment eyelets entails hanging the lightbox from hooks that are attached to a window via a releasable adhesive or via suction cups. Suction-cupped brackets can also be inserted directly into the attachment points 123B and 124B or alternative attachment points, for example on in the corners on the face of the light box. FIG. 6 shows the bottom of the lightbox includes an additional female AC power adapter jack 129A, which provides an additional point for connection of power from the AC power adapter.

Figure 7:
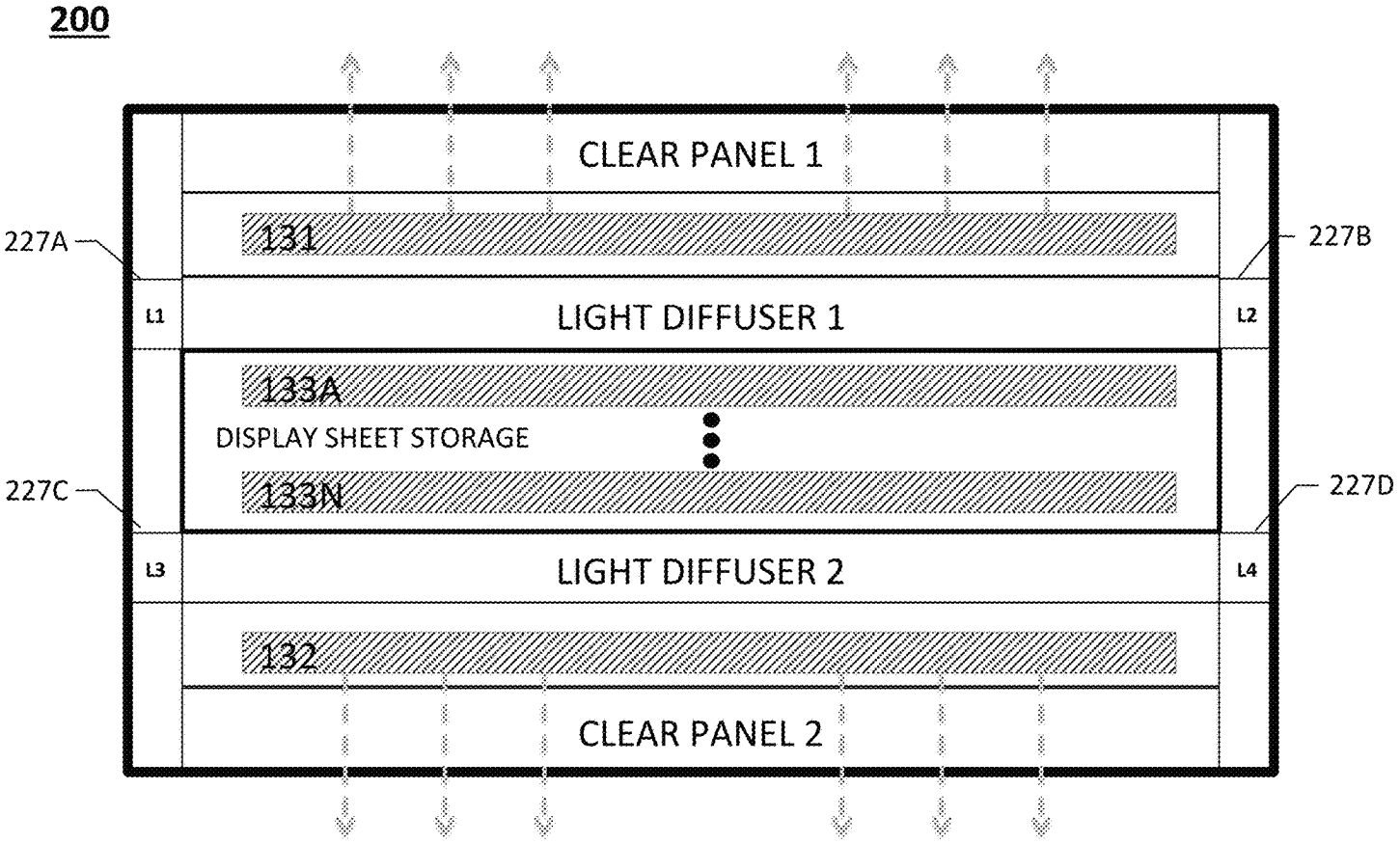
FIG. 7 is a center cross-sectional view of an alternative lightbox corresponding to one or more embodiments of the present invention.

FIG. 7 shows a cross-sectional view of an alternative lightbox assembly 200. Assembly 200, which is conceptually analogous to two instances of assembly 100 placed back to back in a common housing 210 with a shared storage compartment 220. More particularly, assembly 200 includes panels vertical side walls 223 and 224, transparent front panels 225A and 225B, light diffuser panel 226A and 226B, lighting elements 227A-227D, and a central graphic sheet storage compartment 228.

CONCLUSION

In the foregoing specification, specific exemplary embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms, such as second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed. Also, the term "exemplary" is used as an adjective herein to modify one or more nouns, such as embodiment, system, method, device, and is meant to indicate specifically that the noun is provided as a non-limiting example.

What is claimed is:

1. A lightbox assembly configured to be placed on or adjacent to a residential window, the assembly comprising:
- a transparent plastic layer;
- a non-transparent plastic layer generally parallel to the transparent layer;
- a light diffusion layer positioned between and generally parallel to the transparent plastic layer and the non-transparent plastic layer;
- a first set of one or more transparent or translucent graphic image sheets between the transparent layer and the light diffusion layer; and
- a second set of one or more transparent or translucent graphic image sheets between the transparent layer and the non-transparent layer.

2. The assembly of claim 1, further comprising one or more light sources configured to illuminate one or more edge faces of the light diffusion layer.

3. The assembly of claim 1,
- wherein the transparent layer, the non-transparent layer, and the light diffusion layer are generally rectilinear and have corresponding bottom and side boundary edges;
- wherein the assembly further comprises:
- a generally rectilinear frame having a bottom and two sidewalls extending vertically therefrom, with the frame enclosing the bottom and side boundary edges of the transparent layer, the non-transparent layer, and the light diffusion layer; and
- a base support structure configured to removably attach to a bottom portion of the rectilinear frame and provide lateral stability to the frame.

4. The assembly of claim 3, wherein the base support structure includes a bottom surface integrally molded to include an AC power adapter storage cavity.

5. The assembly of claim 2, further comprising a housing at least partially containing each of the layers; and first and second connectors attached to corresponding portions of the housing, with each of the connectors configured to engage with a third connector coupled to an AC power adapter.

6. The assembly of claim 1, wherein the light diffusion layer comprises a panel supporting a plurality of LEDs.

7. The assembly of claim 1, wherein the light diffusion layer includes a reflective metallic coating.

8. The assembly of claim 1, further comprising:
- a housing having an upper portion and a bottom portion, with the bottom portion configured to rest on a residential window sill;
- a base structure configured to rest on a residential window sill and to removably attach to the bottom portion of the housing; and
- means for attaching one or more portions of the housing to a window.

9. The assembly of claim 1, wherein the transparent layer is formatted as a lenticular panel and wherein at least one of the first or second sets of graphic image sheets is configured to cooperate with the lenticular panel.

10. A lightbox assembly configured for residential window sills, the assembly comprising a housing;

a first light diffusion panel positioned within the housing and having a front side and a back side;

a first set of one or more transparent or translucent graphic image sheets within the housing and adjacent to the front side of the first light diffusion panel;

a second set of one or more transparent or translucent graphic image sheets within the housing and adjacent to the back side of the first light diffusion panel; and a second light diffusion panel having a front side and a back side, with the back side facing the second set of graphic image sheets and the front side facing away from the second set of graphic image sheets.

11. The lightbox assembly of claim 10, further comprising:

a third set of one or more transparent or translucent graphic image sheets within the housing and adjacent to the front side of the second light diffusion panel.

12. The lightbox assembly of claim 10, wherein the light diffusion panel comprises an array of Light Emitting Diodes (LEDs).

13. The lightbox assembly of claim 10:

wherein the housing has an upper portion and a bottom portion, with the bottom portion configured to rest on a residential window sill;

a base structure configured to rest on a residential window sill and to removably attach to the bottom portion of the housing; and means for attaching one or more portions of the housing to a window.

14. A method comprising:

positioning a lightbox assembly containing first and second sets of one or more transparent or translucent graphic display sheets on a residential window sill, with the second set of display sheets contained within a storage area configured to prevent viewing of the second display sheets through a front display portion of the light box; and attaching a portion of the light box assembly to a window above the residential window sill via one of a suction cup coupled to the assembly and a self-adhesive strip coupled to the assembly.

15. The method of claim 14: wherein the lightbox assembly includes a light diffusion panel, and wherein the first set of graphic display sheets includes at least two sheets configured to be illuminated concurrently by the light diffusion panel to produce a composite image.

16. The method of claim 15, further comprising removing a graphic display sheet positioned in front of the light diffusion panel, and replacing it with at least one of the second display sheets.

17. The method of claim 15, further comprising:

separating an AC adapter from a base portion of the lightbox assembly; and plugging the AC adapter into a wall outlet adjacent the window.

* * * * *